United States Patent [19]

Nepper

[11] Patent Number: 5,074,465

[45] Date of Patent: Dec. 24, 1991

[54] TRACKWAY SEGMENT FOR TOY VEHICLE TRACKWAY-SYSTEM

[76] Inventor: John P. Nepper, 9826 Hartman Ave., Omaha, Nebr. 68134

[21] Appl. No.: 572,697

[22] Filed: Aug. 27, 1990

[51] Int. Cl.[5] ..... A63H 19/30

[52] U.S. Cl. ..... 238/10 E; 446/444

[58] Field of Search ..... 191/22 C, 23 R, 28; 238/10 R, 10 A, 10 E, 10 F; 446/433, 444

[56] References Cited

U.S. PATENT DOCUMENTS

| | | | |
|---|---|---|---|
| 2,161,314 | 6/1939 | Randall et al. | 238/10 E X |
| 2,231,089 | 2/1941 | Rorer | 238/10 E X |
| 2,992,598 | 7/1961 | Einfalt | 238/10 E X |
| 3,695,513 | 10/1972 | Baynes et al. | 238/10 E |
| 4,496,100 | 1/1985 | Schwager et al. | 238/10 R |

*Primary Examiner*—Frank E. Werner
*Assistant Examiner*—James Eller
*Attorney, Agent, or Firm*—George R. Nimmer

[57] ABSTRACT

Trackway segment connectable, with dual-lobes connectors, in end-to-end relationship with similar trackway segments to provide a trackway-system for toy vehicles. Each trackway segment is singularly constructed throughout of a moldable resinous material and includes: a horizontal floor-panel having directionally longitudinal side-edges, a transverse trail-end, and a transverse lead-end; extending uprightly from the floor-panel, two or more directionally longitudinal and transversely separated divider-panels that provide one or more directionally longitudinal lanes for assignment to individual toy vehicles, each divider-panel being of inverted-U cross-sectional shape wherein the two upright legs are incrementally apexially fused and wherein divider-panels at the floor-panel side-edges are provided with incremental upright stiffeners, and each divider-panel being terminally provided with an upright trail-panel and an upright lead-panel; and the floor-panel being trailwardly or leadwardly provided with a horizontal extension-panel that is insertable below the floor-panel of a neighboring trackway segment. The dual-lobes connectors are respectively visually obscured within abutting divider-panels of consecutive trackway segments and therewithin removably engage the trail-panel and lead-panel of consecutive trackway segments.

6 Claims, 2 Drawing Sheets

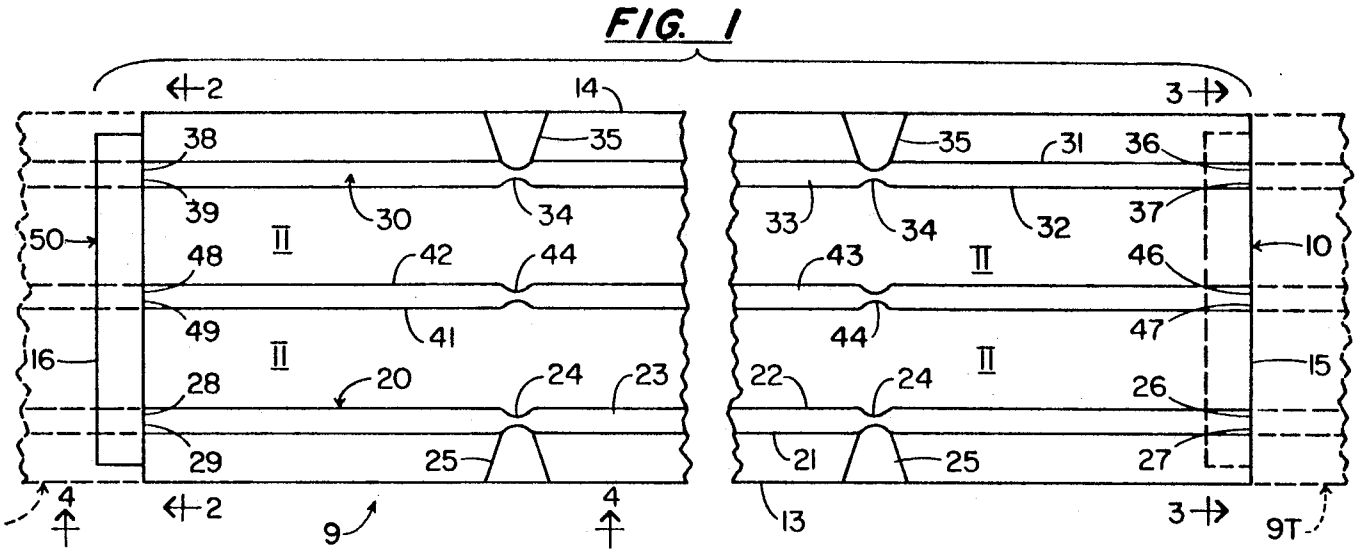
FIG. 1
3
3
10
15
9T
36
37
46
47
26
27
31
32
35
34
43
44
24
25
33
22
21
13
II
II
14
35
34
44
24
23
4
4
42
41
30
20
25
9
38
39
48
49
28
29
2
2
50
16
9L
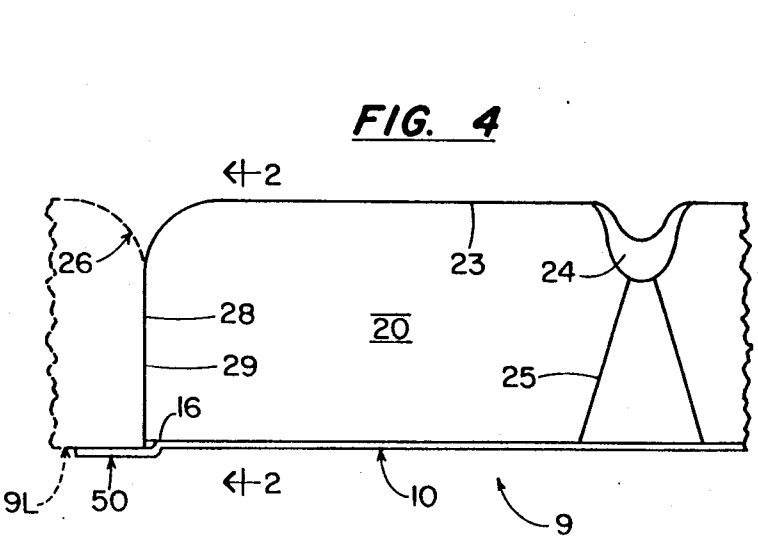
FIG. 4
24
25
9
23
20
10
2
2
28
29
16
26
50
9L
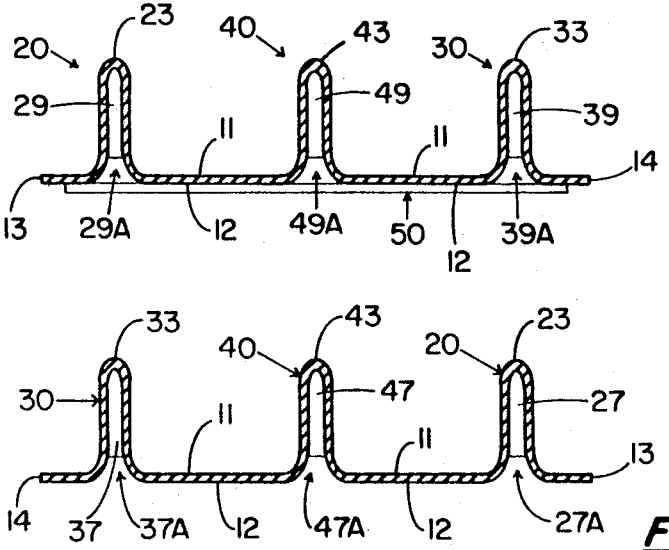
FIG. 2
FIG. 3
14
33
39
39A
30
12
11
50
43
49
49A
40
11
12
23
29A
20
29
13
13
27
27A
23
20
12
11
43
47
47A
40
12
11
33
37A
37
30
14

TRACKWAY SEGMENT FOR TOY VEHICLE TRACKWAY-SYSTEM

OBJECTIVE OF THE INVENTION

It is the general objective of the present invention to provide a trackway segment removably connectable, with reliable and visually obscured connectors, in end-to-end relationship with similar trackway segments to provide an abruptly laned trackway-system for toy vehicles.

It is an ancillary objective to provide trackway segments that can be furnished with one or more longitudinally extending and uprightly abruptly distinct parallel lanes whereby the resultant trackway-system has a segregated lane assignable to an individual toy vehicle.

It is another ancillary objective to provide linear and curved trackway segments that can be removably connected endwise into various shapes of trackway-system courses.

It is a specific objective to provide a trackway segment that can be economically molded throughout with minimal amounts of resinous structural material and yet having a structural strength adequate for maintaining the desired shape and attitude and for securely accommodating inter-segments removable connections.

It is a specific objective to provide a trackway segment that is adapted for secure removable endwise connection to neighboring trackway segments and including the ancillary provision of visually obscure, non-interfering, removable connections between neighboring trackway segments.

GENERAL STATEMENT OF THE INVENTION

With the above mentioned objectives in view, and together with other related objectives which will become more apparent as this description proceeds, the novel trackway segment of the present invention, and which is preferably singularly constructed throughout of the same selected resinous material, generally comprises: a horizontal floor-panel having directionally longitudinal side-edges, a transverse trail-end, and a transverse lead-end; extending uprightly from the floor-panel, two or more directionally longitudinal and transversely separated uprightly abrupt divider-panels that provide one or more directionally longitudinal lanes that are respectively assignable to individual toy vehicles, each divider-panel being of dual-legs inverted-U cross-sectional shape wherein the two legs are incrementally apexially fused and wherein divider-panels adjacent the floor-panel side-edges are provided with incremental upright stiffeners, and each divider-panel being terminally provided with an upright trail-panel that is separated from the floor-panel and with an upright lead-panel that is spatially separated from the floor-panel; the floor-panel being trailwardly or leadwardly provided with a transversely extending horizontal extension-panel that is supportably insertable below the floor-panel of a neighboring trackway segment; and visually obscured within abutting divider-panels of consecutive trackway segments, a dual-lobes inter-segments connector that removably engages the trail-panel and lead-panel of consecutive trackway segments.

BRIEF DESCRIPTION OF THE DRAWING

In the drawing, wherein like characters refer to like parts in the several views, and in which:

FIG. 1 is a top plan view of a representative trackway segment of the present invention, and as indicated by phantom lines is assemblable in end-to-end relationship with analagous segments into a trackway-system;

FIG. 2 is a transversely extending sectional elevational view taken along lines 2—2 of FIGS. 1 and 4;

FIG. 3 is a transversely extending sectional elevational view taken along lines 3—3 of FIG. 1;

FIG. 4 is a detail elevational view of FIG. 1 and as seen in the direction 4—4 of FIG. 1;

DETAILED DESCRIPTION OF THE DRAWING

Figure 5:
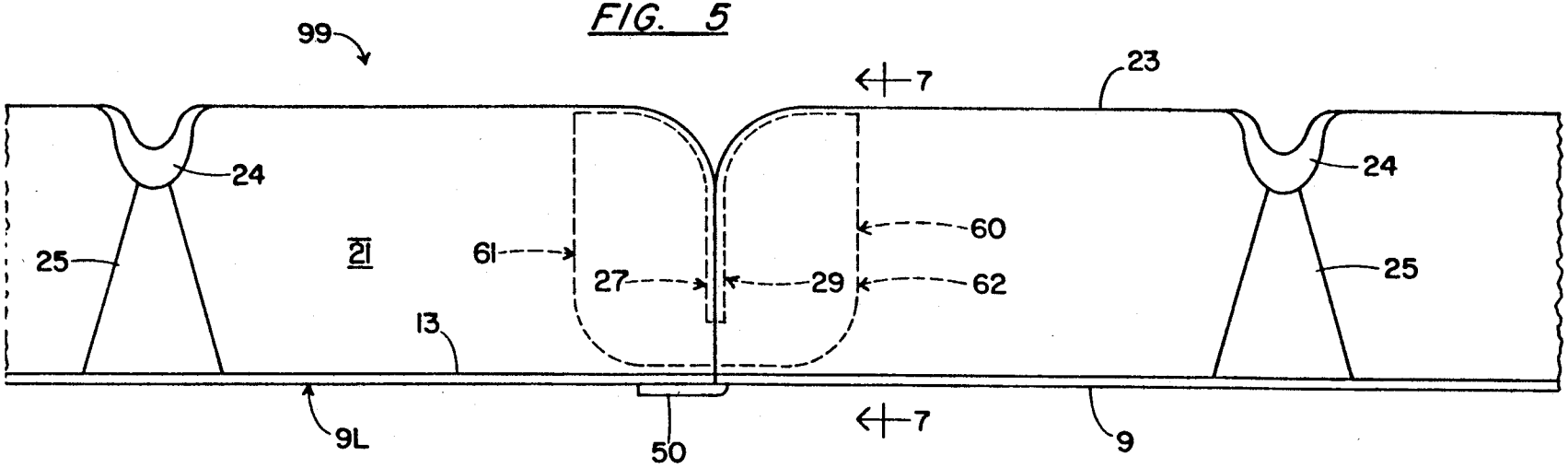
FIG. 5 is an elevational view similar to FIG. 4 showing the FIG. 1 trackway segments in removably connected end-to-end relationship.

Referring initially to drawing FIGS. 1-4 which depict a representative embodiment trackway segment (9) of the present invention. Trackway segment 9 comprises a horizontal floor-panel 10 having opposed horizontal planar surfaces including upper-surface 11 and lower-surface 12 which is supportable upon a suitable horizontal substrate (not shown). Floor-panel 10 has directionally longitudinal side-edges including left-edge 13 and right-edge 14, and also has directionally transverse ends including trail-end 15 and lead-end 16.

Extending uprightly from and singularly constructed with floor-panel 10 is a plurality of directionally longitudinal and directionally transversely separated parallel divider-panels (20, 30, 40, etc.) that provide, between divider-panels, a plurality of directionally longitudinal parallel vehicular lanes. Desireably, each divider-panel is of dual-legs inverted-U cross-sectional shape. Among the divider-panels herein are:

(a) left-divider 20 inwardly offset from left-edge 13 and comprising upright legs 21 and 22 merging at apex 23;

(b) right-divider 30 inwardly offset from right-edge 14 and comprising upright legs 31 and 32 merging at apex 33; and (c) one or more central-dividers (40) respectively having upright and apexially merging legs (41-43), and which equally divide the transverse space between left-divider 20 and right-divider 30 into two or more vehicular lanes.

For purposes of enhancing trackway strength, distinct longitudinal increments of left-divider legs 21 and 22 are apexially fused (24), and leg 21 is integrally provided with stiffeners 25 extending downwardly from each heat-weld 24 to floor-panel left-edge 13. Similarly, distinct longitudinal increments of right-divider legs 31 and 32 are apexially fused (34), and stiffeners 35 extend from each heat-weld 34 to floor-panel right-edge 14.

Though the trackway segment (9) illustrated has linear side-edges (13, 14) and linear divider-panel (20, 30, 40) to define linear vehicular lanes, it is to be understood that the side-edges and divider-panels could be of substantially parallel curvatures to define curved vehicular lanes.

Each divider-panel has a trailing-end (26, 36, 46) located adjacent floor-panel trail-end 15, and at the trailing-end is integrally provided with an upright trail-panel (27, 37, 47). Similarly, each divider-panel has a leading-end (28, 38, 48) located adjacent floor-panel lead-end 16, and at the leading-end is integrally provided with an upright lead-panel (29, 39, 49). Such upright trail-panels and lead-panels of end-to-end trackway segments (9L, 9, 9T, etc.) are abuttably confrontable ancillary to connecting them into a trackway-system (99). Preferably, the trail-panel extends across upper portions only of the divider-panel trailing-end whereby a trail-opening (27A, 37A, 47A) exists therebelow and immediately above floor-panel upper-surface 11. Similarly, the lead-panel preferably extends across upper portions only of the divider-panel leading-end whereby a lead-opening (29A, 39A, 49A) exists therebelow and immediately above floor-panel upper-surface 11. By virtue of these horizontally alignable trail-openings and lead-openings for end-to-end trackway segments, the preferred inter-segments removable attachment means (60) can be employed.

A desirable optional feature comprises a horizontal extension-panel 50, which is recessed below floor-panel lower-surface 12 and singularly constructed with the floor-panel, extends leadwardly of floor-panel lead-end 16. Such extension-panel 50 is adapted to function as an underlying steadying means for the trail-end 15 of a neighboring trackway segment.

Figure 7:
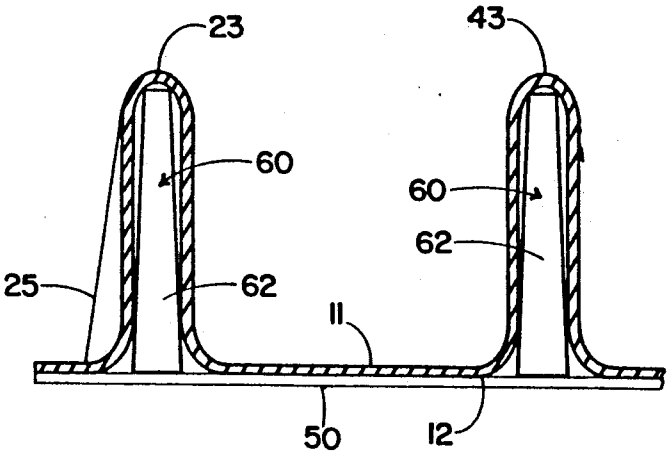
FIG. 7 is a sectional elevational view taken along lines 7—7 of FIGS. 5 and 6.
Figure 6:
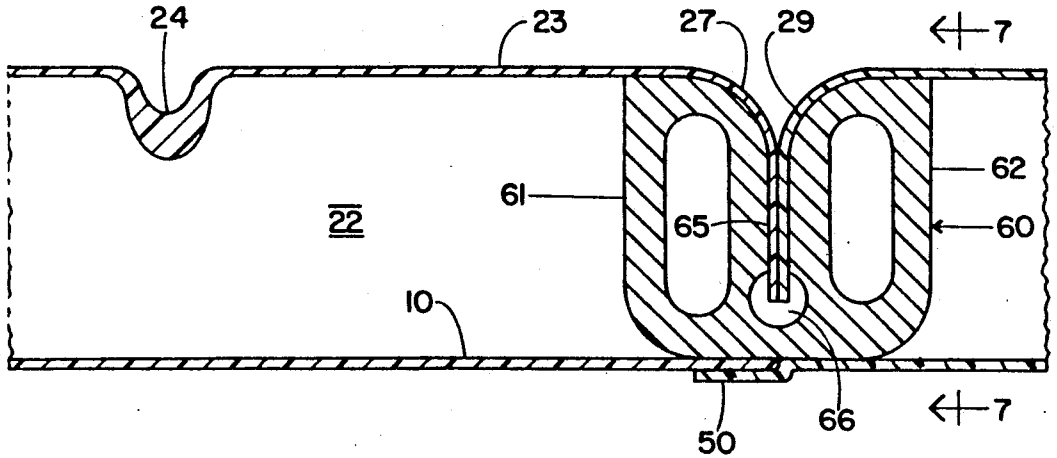
FIG. 6 is a sectional elevational view of FIG. 5.

Drawing FIG. 5 differs from drawing FIG. 4 in that FIG. 5 specifically alludes to usage of a removable attachment means (e.g. novel upright connector 60) between respectively horizontally aligned trail-openings and lead-openings (27A, 29A; 37A, 39A; 47A, 49A) of end-to-end trackway segments (9L, 9, 9T, etc.). In this vein, a trail-panel and a lead-panel (27, 29; 37, 39; 47, 49) extend into and are together frictionally engaged by the upright slotted central portion 65 of connector 60. Connector 60 comprises upright lobes 61 and 62 separated by said upright slotted portion 65 and which slotted portion has an enlarged lower terminus 66. In accordance with the upward convergency of the divider-panel legs (21-22, 31-32, 41-42), and as clearly seen in FIG. 7, connector 60 in transverse section is of upwardly convergent configuration.

From the foregoing, the construction and operation of the trackway segment for toy vehicles trackway-systems will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

What Is Claimed Is As Follows:

1. Trackway segment connectable in an end-to-end relationship with similar trackway segments to provide a trackway-system for toy vehicles, said trackway segment comprising:

(A) a horizontal floor-panel laminarly constructed of thermoplastic resinous material, said floor-panel having a pair of directionally longitudinal horizontal side-edges including a left-edge and a right-edge, said floor-panel also having a pair of directionally transverse ends including a trail-end and a lead-end;

(B) a plurality of directionally longitudinal and transversely directionally separated parallel divider-panels that provide a plurality of directionally longitudinal vehicular lanes, said divider-panels including a left-divider inwardly offset from the floor-panel left-edge and a right-divider inwardly offset from the floor-panel right-edge, each divider-panel having a trailing end located adjacent the floor-panel trail-end and also a leading-end located adjacent the floor-panel lead-end, each divider-panel being of dual-legs inverted-U cross-sectional shape and extending upwardly from and singularly constructed with said resinous floor-panel, the legs of each divider-panel and at distinct longitudinal increments therealong and elevated above the floor-panel being fused together, the left-divider at a fused increment including a singularly constructed stiffener that extends downwardly toward the floor-panel left-edge, and the right-divider at a fused increment including a singularly constructed stiffener that extends downwardly toward the floor-panel right-edge; and (C) an upright trail-panel singularly constructed with and extending directionally transverse across a divider-panel trailing-end and an upright lead-panel singularly constructed with and extending directionally transverse across a divider-panel leading-end, whereby trail-panels and lead-panels of end-to-end trackway segments are joinable for connecting trackway segments into a trackway-system.

2. The trackway segment of claim 1 wherein the trail-panel extends across upper portions only of a divider-panel trailing-end whereby a trail-opening exists thereat, immediately above the floor-panel; and wherein said lead-panel extends across upper portions only of a divider-panel leading-end whereby a lead-opening exists thereat, immediately above the floor-panel.

3. The trackway segment of claim 2 wherein there is a horizontal extension-panel recessed below and singularly constructed with said floor-panel, said extension-panel extending leadwardly of said floor-panel lead-end.

4. The trackway segment of claim 3 wherein the plurality of divider-panels includes at least one central-divider that is parallel to and that substantially equally divides the transverse space between said left-divider and said right-divider into a plurality of longitudinally extending upright lanes assignable to individual toy vehicles.

5. The trackway segment of claim 2 having at its upright trail-panel a connection means to a confronting upright lead-panel of another and trailward said trackway segment, having at its upright lead-panel a connection means to a confronting upright trail-panel of another and leadward said trackway segment, to thereby provide a three-segments trackway-system for toy vehicles.

6. The trackway segment of claim 5 wherein each said inter-segments connection means is visually obscured by and located within abutting divider-panels and comprises a pair of upright lobes removably engaged to a lead-panel and to a trail-panel of consecutive trackway segments.

* * * * *